US006506338B1

(12) United States Patent
Gedevanishvili et al.

(10) Patent No.: US 6,506,338 B1
(45) **Date of Patent: *Jan. 14, 2003**

(54) PROCESSING OF IRON ALUMINIDES BY PRESSURELESS SINTERING OF ELEMENTAL IRON AND ALUMINUM

(75) Inventors: Shalva Gedevanishvili, Richmond, VA (US); Seetharama C. Deevi, Midlothian, VA (US)

(73) Assignee: Chrysalis Technologies Incorporated, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/549,668

(22) Filed: Apr. 14, 2000

(51) Int. Cl.[7] ..... B22F 3/12
(52) U.S. Cl. ..... 419/45; 419/46; 419/57; 419/60
(58) Field of Search ..... 419/45, 46, 57, 419/60

(56) References Cited

U.S. PATENT DOCUMENTS

| | | | | |
|---|---|---|---|---|
| 4,917,858 A | | 4/1990 | Eylon et al. | |
| 4,961,903 A | | 10/1990 | McKamey et al. | |
| 4,992,233 A | * | 2/1991 | Swaroop et al. | 419/2 |
| 5,024,109 A | | 6/1991 | Romero et al. | |
| 5,098,469 A | | 3/1992 | Rezhets | |
| 5,158,744 A | | 10/1992 | Nazmy | |
| 5,269,830 A | | 12/1993 | Rabin et al. | |
| 5,320,802 A | | 6/1994 | Liu et al. | |
| 5,330,701 A | * | 7/1994 | Shaw et al. | 410/10 |
| 5,455,001 A | | 10/1995 | Hu | |
| 5,482,673 A | | 1/1996 | Alexander et al. | |
| 5,484,568 A | | 1/1996 | Sekhar et al. | |
| 5,545,373 A | * | 8/1996 | Maziasz et al. | 420/81 |
| 5,595,706 A | | 1/1997 | Sikka et al. | |
| 5,620,651 A | | 4/1997 | Sikka et al. | |
| 5,848,348 A | | 12/1998 | Dennis | |
| 5,976,458 A | | 11/1999 | Sikka et al. | |
| 6,030,472 A | | 2/2000 | Hajaligol et al. | |
| 6,033,623 A | * | 3/2000 | Deevi et al. | 419/45 |
| 6,284,191 B1 | * | 9/2001 | Deevi et al. | 419/46 |

OTHER PUBLICATIONS

Notification of Transmittal of the International Preliminary Examination Report dated Apr. 15, 2002.

J.R. Knibloe et al., "Microstructure and Mechanical Properties of P/M $Fe_3Al$ Alloys", Advances in Powder Metallurgy, 1990, vol. 2, pp. 219–231.

V.K. Sikka et al., "Powder Production, Processing, and Properties of $Fe_3Al$", presented at the 1990 Powder Metallurgy Conference Exhibition in Pittsburgh, PA, pp. 1–11.

V.K. Sikka, "Powder Processing of $Fe_3Al$–Based Iron–Aluminide Alloys", Mat. Res. Soc. Symp. Proc., vol. 213, pp. 901–906.

A. LeFort et al., "Mechanical Behavior of $FeAl_{40}$Intermetallic Alloys", presented at the Proceedings of International Symposium on Intermetallic Compounds—Structure and Mechanical Properties (JIMIS–6), pp. 579–583, Sendai, Japan on Jun. 17–20, 1991.

(List continued on next page.)

*Primary Examiner*—Daniel J. Jenkins
(74) *Attorney, Agent, or Firm*—Burns, Doane, Swecker & Mathis, LLP

(57) ABSTRACT

A pressureless sintering process for producing FeAl wherein the heating rate is controlled in a manner which minimizes expansion of a mixture of elemental powders of iron and aluminum. During the process, the heating rate is maintained below 1° C./min to minimize the volume expansion during the formation of the intermediate phase $Fe_2Al_5$. As a result of the process, the final density can be increased up to 95% of the theoretical density. The sequence of phases formed during the heating of Fe+Al mixture were identified by X-ray diffraction, optical microscopy, SEM and along with DSC data were correlated to the expansion and shrinkage behavior of the samples.

23 Claims, 14 Drawing Sheets

OTHER PUBLICATIONS

D. Pocci et al., "Production and Properties of CSM FeAl Intermetallic Alloys", presented at the Minerals, Metals and Materials Society Conference (1994 TMS Conference) on Processing, Properties and Applications of Iron Aluminides, pp. 19–30, held in San Francisco, California on Feb. 27–Mar. 3, 1994.

J.H. Schneibel, "Selected Properties of Iron Aluminides", pp. 329–341, presented at the 1994 TMS Conference.

J. Baker, "Flow and Fracture of FeAl", pp. 101–115, presented at the 1994 TMS Conference.

D.J. Alexander, "Impact Behavior of FeAl Alloy FA–350", pp. 193–202, presented at the 1994 TMS Conference.

C.H. Kong, "The Effect of Ternary Additions on the Vacancy Hardening and Defect Structure of FeAl", pp. 231–239, presented at the 1994 TMS Conference.

D.J. Gaydosh et al., "Microstructure and Tensile Properties of Fe–40 At.Pct. A1 Alloys with C, Zr, Hf and B Additions", Sep. 1989 Met. Trans A., vol. 20A, pp. 1701–1714.

C.G. McKamey et al., "A review of recent developments in $Fe_3Al$–based Alloys" in Aug. 1991 J. of Mater. Res., vol. 6, No. 8, pp. 1779–1805.

B.H. Rabin et al., "Synthesis of Iron Aluminides from Elemental Powders: Reaction Mechanisms and Densification Behavior", Metallurgical Transactions, vol. 22A, Feb. 1991, pp. 277–286.

D.J. Lee et al., "Sintering Behavior of Iron–Aluminum Powder Mixes", Intl. Journal of Powder Metallurgy & Powder Technology, vol. 21, No. 1, 1985 Am. Powder Metallurgy Institute, pp. 9–21.

David C. Dunand, "Reactive Synthesis of Aluminide Intermetallics", Materials and Manufacturing Processes, vol. 10, No. 3, pp. 373–403, 1995.

R.M. German, "Transient Thermal Effects in the Synthesis of Intermetallic Alloys", Thermal Analysis in Metallurgy, The Minerals, Metals & Materials Society, 1992, pp. 205–231.

D.L. Joslin et al., "Processing of $Fe_3Al$ and FeAl alloys by reaction synthesis", Intermetallics 3 (1995), pp. 467–481.

S. Ranganath et al., "Synthesis of iron aluminide under thermal explosion conditions", Materials Letters, vol. 10, No. 4,5, Nov. 1990, pp. 215–217.

Yu–Leng Jeng et al., "Powder Metallurgy Processing of Dual–Phase Fe–Al Intermetallics", Intl. Journal of Powder Metallurgy, vol. 31, No. 2, 1995, pp. 155–166.

J.R. Blackford et al., "Production of Iron Aluminides By Co–Rolling of Elemental Foils Followed by Heat Treatment", Scripta Materialia, 1996, vol. 34, No. 5, pp. 721–728.

Jin Li et al., "The Fabrication of High Density Intermetallic Compounds by Pressureless Sintering", Proc. $5^{th}$ Japan Intl. SAMPE Symposium, Oct. 28–31, 1997, pp. 265–270.

D.Q. Yi et al., "Preparation of $Fe_3Al$ based iron aluminides from elemental and prealloyed powders", Materials Science and Technology, Jul. 1995, vol. 11, pp. 650–655.

Zuhair A. Munir, "Synthesis of High Temperature Materials by Self–Propagating Combustion Methods", Ceramic Bulletin, vol. 67, No. 2, 1988, pp. 342–349.

S. Sheasby, "Powder Metallurgy of Iron–Aluminum", Intl. Journal of Powder Metallurgy & Powder Technology, vol. 15, No. 4, 1979, pp. 301–305.

A. Bose et al., "Reactive Sintering and Reactive Hot Isostatic Pressing of Iron Aluminides", Proceedings of the 1991 Powder Metallurgy Conference & Exhibition, Chicago, IL, Jun. 9–12, 1991, vol. 6, pp. 131–145.

B.H. Rabin et al., "Microstructure and Tensile Properties of $Fe_3Al$ Produced by Combustion Synthesis/Hot Isostatic Pressing", Metallurgical Transactions A, vol. 23A, Jan. 1992, pp. 35–40.

D.L. Joslin et al., "Reaction synthesis of Fe–Al alloys", Materials Science and Engineering A192/193 (1995), pp. 544–548.

* cited by examiner a)

b)

PROCESSING OF IRON ALUMINIDES BY PRESSURELESS SINTERING OF ELEMENTAL IRON AND ALUMINUM

FIELD OF THE INVENTION

The invention relates to improvements in powder processing of intermetallic materials such as iron aluminides.

BACKGROUND OF THE INVENTION

Iron base alloys containing aluminum can have ordered and disordered body centered crystal structures. For instance, iron aluminide alloys having intermetallic alloy compositions contain iron and aluminum in various atomic proportions such as $Fe_3Al$, FeAl, $FeAl_2$, $FeAl_3$, and $Fe_2Al_5$. $Fe_3Al$ intermetallic iron aluminides having a body centered cubic ordered crystal structure are disclosed in U.S. Pat. Nos. 5,320,802; 5,158,744; 5,024,109; and 4,961,903. Such ordered crystal structures generally contain 25 to 40 atomic % Al and alloying additions such as Zr, B, Mo, C, Cr, V, Nb, Si and Y.

A 1990 publication in Advances in Powder Metallurgy, Vol. 2, by J. R. Knibloe et al., entitled "Microstructure And Mechanical Properties of P/M $Fe_3Al$ Alloys", pp. 219–231, discloses a powder metallurgical process for preparing $Fe_3Al$ containing 2 and 5% Cr by using an inert gas atomized powder. This publication explains that $Fe_3Al$ alloys have a $DO_3$ structure at low temperatures and transform to a $B_2$ structure above about 550° C. To make sheet, the powders were canned in mild steel, evacuated and hot extruded at 1000° C. to an area reduction ratio of 9:1. After removing from the steel can, the alloy extrusion was hot forged at 1000° C. to 0.340 inch thick, rolled at 800° C. to sheet approximately 0.10 inch thick and finish rolled at 650° C. to 0.030 inch. According to this publication, the atomized powders were generally spherical and provided dense extrusions and room temperature ductility approaching 20% was achieved by maximizing the amount of B2 structure.

A 1991 publication in Mat. Res. Soc. Symp. Proc., Vol. 213, by V. K. Sikka entitled "Powder Processing of $Fe_3Al$-Based Iron-Aluminide Alloys," pp. 901–906, discloses a process of preparing 2 and 5% Cr containing $Fe_3Al$-based iron-aluminide powders fabricated into sheet. This publication states that the powders were prepared by nitrogen-gas atomization and argon-gas atomization. The nitrogen-gas atomized powders had low levels of oxygen (130 ppm) and nitrogen (30 ppm). To make sheet, the powders were canned in mild steel and hot extruded at 1000° C. to an area reduction ratio of 9:1. The extruded nitrogen-gas atomized powder had a grain size of 30 $\mu$m. The steel can was removed and the bars were forged 50% at 1000° C., rolled 50% at 850° C. and finish rolled 50% at 650° C. to 0.76 mm sheet.

A paper by V. K. Sikka et al., entitled "Powder Production, Processing, and Properties of $Fe_3Al$", pp. 1–11, presented at the 1990 Powder Metallurgy Conference Exhibition in Pittsburgh, Pa., discloses a process of preparing $Fe_3Al$ powder by melting constituent metals under a protective atmosphere, passing the metal through a metering nozzle and disintegrating the melt by impingement of the melt stream with nitrogen atomizing gas. The powder had low oxygen (130 ppm) and nitrogen (30 ppm) and was spherical. An extruded bar was produced by filling a 76 mm mild steel can with the powder, evacuating the can, heating 1½ hour at 1000° C. and extruding the can through a 25 mm die for a 9:1 reduction. The grain size of the extruded bar was 20 $\mu$m. A sheet 0.76 mm thick was produced by removing the can, forging 50% at 1000° C., rolling 50% at 850° C. and finish rolling 50% at 650° C.

A publication by A. LeFort et al., entitled "Mechanical Behavior of $FeAl_{40}$ Intermetallic Alloys" presented at the Proceedings of International Symposium on Intermetallic Compounds—Structure and Mechanical Properties (JIMIS-6), pp. 579–583, held in Sendai, Japan on Jun. 17–20, 1991, discloses various properties of FeAl alloys (25 wt. % Al) with additions of boron, zirconium, chromium and cerium. The alloys were prepared by vacuum casting and extruding at 1100° C. or formed by compression at 1000° C. and 1100° C. This article explains that the excellent resistance of FeAl compounds in oxidizing and sulfidizing conditions is due to the high Al content and the stability of the B2 ordered structure.

A publication by D. Pocci et al., entitled "Production and Properties of CSM FeAl Intermetallic Alloys" presented at the Minerals, Metals and Materials Society Conference (1994 TMS Conference) on "Processing, Properties and Applications of Iron Aluminides", pp. 19–30, held in San Francisco, Calif. on Feb. 27–Mar. 3, 1994, discloses various properties of $Fe_{40}Al$ intermetallic compounds processed by different techniques such as casting and extrusion, gas atomization of powder and extrusion and mechanical alloying of powder and extrusion and that mechanical alloying has been employed to reinforce the material with a fine oxide dispersion. The article states that FeAl alloys were prepared having a B2 ordered crystal structure, an Al content ranging from 23 to 25 wt. % (about 40 at %) and alloying additions of Zr, Cr, Ce, C, B and $Y_2O_3$. The article states that the materials are candidates as structural materials in corrosive environments at high temperatures and will find use in thermal engines, compressor stages of jet engines, coal gasification plants and the petrochemical industry.

A publication by J. H. Schneibel entitled "Selected Properties of Iron Aluminides", pp. 329–341, presented at the 1994 TMS Conference discloses properties of iron aluminides. This article reports properties such as melting temperatures, electrical resistivity, thermal conductivity, thermal expansion and mechanical properties of various FeAl compositions.

A publication by J. Baker entitled "Flow and Fracture of FeAl", pp. 101–115, presented at the 1994 TMS Conference discloses an overview of the flow and fracture of the B2 compound FeAl. This article states that prior heat treatments strongly affect the mechanical properties of FeAl and that higher cooling rates after elevated temperature annealing provide higher room temperature yield strength and hardness but lower ductility due to excess vacancies. With respect to such vacancies, the articles indicates that the presence of solute atoms tends to mitigate the retained vacancy effect and long term annealing can be used to remove excess vacancies.

A publication by D. J. Alexander entitled "Impact Behavior of FeAl Alloy FA-350", pp. 193–202, presented at the 1994 TMS Conference discloses impact and tensile properties of iron aluminide alloy FA-350. The FA-350 alloy includes, in atomic %, 35.8% Al, 0.2% Mo, 0.05% Zr and 0.13% C.

A publication by C. H. Kong entitled "The Effect of Ternary Additions on the Vacancy Hardening and Defect Structure of FeAl", pp. 231–239, presented at the 1994 TMS Conference discloses the effect of ternary alloying additions on FeAl alloys. This article states that the B2 structured compound FeAl exhibits low room temperature ductility and unacceptably low high temperature strength above 500° C. The article states that room temperature brittleness is caused by retention of a high concentration of vacancies following high temperature heat treatments. The article discusses the effects of various ternary alloying additions such as Cu, Ni, Co, Mn, Cr, V and Ti as well as high temperature annealing and subsequent low temperature vacancy-relieving heat treatment.

A publication by D. J. Gaydosh et al., entitled "Microstructure and Tensile Properties of Fe40 At.Pct. Al Alloys with C, Zr, Hf and B Additions" in the September 1989 Met. Trans A, Vol. 20A, pp. 1701–1714, discloses hot extrusion of gas-atomized powder wherein the powder either includes C, Zr and Hf as prealloyed additions or B is added to a previously prepared iron-aluminum powder.

A publication by C. G. McKamey et al., entitled "A review of recent developments in $Fe_3Al$-based Alloys" in the August 1991 J. of Mater. Res., Vol. 6, No. 8, pp. 1779–1805, discloses techniques for obtaining iron-aluminide powders by inert gas atomization and preparing ternary alloy powders based on $Fe_3Al$ by mixing alloy powders to produce the desired alloy composition and consolidating by hot extrusion, i.e., preparation of $Fe_3Al$-based powders by nitrogen- or argon-gas atomization and consolidation to full density by extruding at 1000° C. to an area reduction of $\leqq$9:1.

U.S. Pat. Nos. 4,917,858; 5,269,830; and 5,455,001 disclose powder metallurgical techniques for preparation of intermetallic compositions by (1) rolling blended powder into green foil, sintering and pressing the foil to full density, (2) reactive sintering of Fe and Al powders to form iron aluminide or by preparing Ni—B—Al and Ni—B—Ni composite powders by electroless plating, canning the powder in a tube, heat treating the canned powder, cold rolling the tube-canned powder and heat treating the cold rolled powder to obtain an intermetallic compound.

U.S. Pat. No. 5,484,568 discloses a powder metallurgical technique for preparing heating elements by micropyretic synthesis wherein a combustion wave converts reactants to a desired product. In this process, a filler material, a reactive system and a plasticizer are formed into a slurry and shaped by plastic extrusion, slip casting or coating followed by combusting the shape by ignition.

U.S. Pat. Nos. 5,098,469 and 5,269,830 disclose techniques for preparing intermetallic alloy compositions by powder metallurgical techniques which include pressureless sintering. The '469 patent discloses a four step pressureless sintering process for producing Ni—Al—Ti intermetallic aluminide alloys wherein a compact of nickel powder and prealloyed aluminide powder is heated without cool down steps and with a heating rate of 10° C. per minute between the processing steps. The '830 patent discloses a pressureless sintering process for producing $Fe_3Al$ and FeAl compounds wherein elemental powders of iron and aluminum are heated under conditions of temperature and pressure to produce an exothermic reaction and densification is achieved by sintering in vacuum or by pressure assisted densification by heating during compression. According to the '830 patent, pressureless sintering achieves near 75% of full density.

Based on the foregoing, there is a need in the art for an economical technique for preparing intermetallic compositions such as iron aluminides. For instance, conventional powder metallurgical techniques of preparing iron-aluminides include melting iron and aluminum and inert gas atomizing the melt to form an iron-aluminide powder, canning the powder and working the canned material at elevated temperatures or reaction synthesis can be used to react elemental powders of iron and aluminum. It would be desirable if iron-aluminide could be prepared by a powder metallurgical technique wherein it is not necessary to can the powder and wherein it is not necessary to subject the iron and aluminum to any hot working steps in order to form an iron-aluminide sheet product.

Other publications which disclose aluminide processing techniques include commonly-owned U.S. Pat. Nos. 5,595,706; 5,620,651; 5,976,458; 6,030,472; and 6,033,623.

SUMMARY OF THE INVENTION

The invention provides a method of manufacturing an iron aluminide intermetallic alloy composition by a powder metallurgical technique, comprising steps of forming a powder mixture comprising aluminum powder and iron powder, heating the powder mixture so as to react the aluminum powder and the iron powder to form a first reacted compact containing $Fe_2Al_5$, free-aluminum and free-iron, heating the first reacted compact so as to react the free-iron with the free-aluminum and/or the $Fe_2Al_5$ to form a second reacted compact containing FeAl, $Fe_2Al_5$ and free-iron; and heating the second compact so as to react the free-iron with the FeAl and/or the $Fe_2Al_5$ to form a sintered compact containing FeAl.

The heating steps are preferably carried out in a vacuum or inert gas (e.g., argon or helium with or without minor additions of hydrogen) environment such that (1) the $Fe_2Al_5$ is formed by a solid state reaction without melting the aluminum powder and/or expansion of the first reacted compact due to volume change during formation of the $Fe_2Al_5$ is less than 10%, (2) the aluminum powder is completely melted during formation of the FeAl and/or expansion of the second reacted compact due to volume change during formation of the FeAl is less than 10%, (3) the FeAl initially forms as a layer between the iron powder and the $Fe_2Al_5$, and/or (4) expansion of the sintered compact due to volume change during formation of the FeAl is less than 10%. In a preferred process, the powder mixture is heated at a heating rate of less than 1° C./min and/or the sintered compact is heated sufficiently to increase the density of the sintered compact to at least 90%, more preferably at least about 95% of the theoretical density. The process can include a step of pressing the powder mixture into a shaped article.

According to the process, the following reactions can sequentially occur during the heating steps: (1) $Fe_2Al_5$ is formed as a layer around the individual particles of the iron powder without melting of the aluminum powder, (2) the aluminum powder melts and diffuses into the iron powder, (3) some of the FeAl is formed by an interfacial reaction between the iron powder and the $Fe_2Al_5$, and (4) the balance of the FeAl is formed by a solid state diffusion.

DETAILED DESCRIPTION OF THE PREFERRED EMBODIMENTS

Figure 1A:
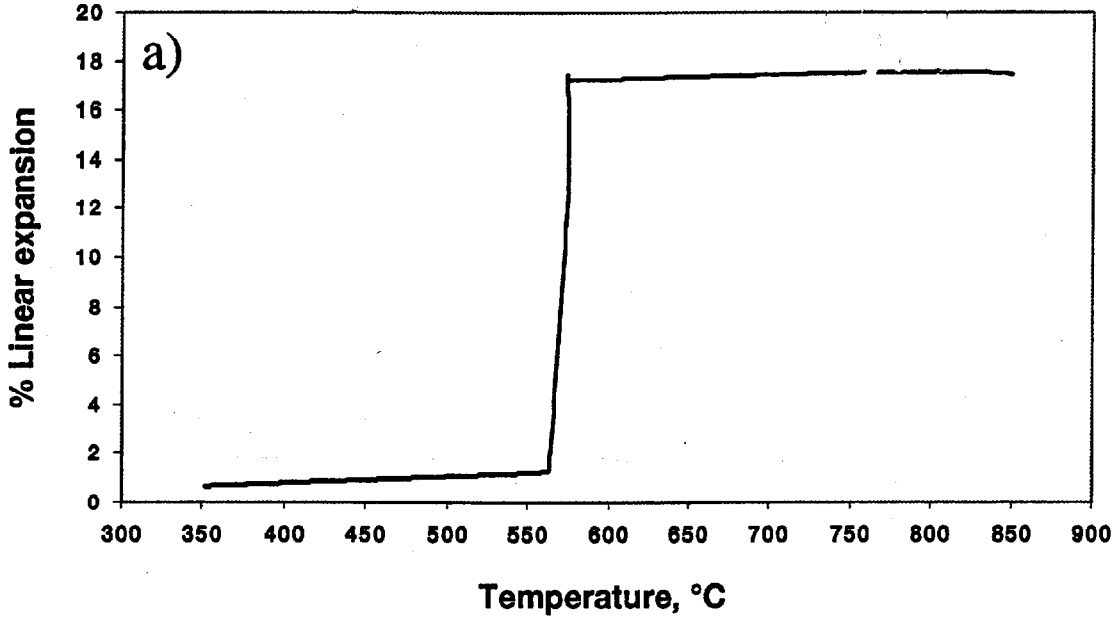
FIG. 1*a* shows the thermal expansion curve of a pellet of iron and aluminum powders heated at 5° C./min over the temperature range of 350 to 850° C.

Intermetallic compounds have been the subject of scientific interest for more than fifty years because of their attractive physical and mechanical properties. In recent years research has focused on the use of monolithic intermetallic materials based on $Ni_3Al$, NiAl, $Fe_3Al$, FeAl, $Ti_3Al$ and TiAl as replacements for denser structural materials such as steel or superalloys for high temperature service. Among the intermetallics, iron aluminides are attractive for high temperature applications due to their low density, low material cost and good high temperature mechanical properties. In addition they exhibit excellent corrosion resistance in oxidizing and sulfidizing atmospheres due to the formation of protective $Al_2O_3$ scales.

Of the iron aluminides, FeAl has a B2 structure and exists over a wide range of Al concentrations at room temperature (36 to ~50at. %). Iron aluminides based on FeAl exhibit better oxidation resistance than $Fe_3Al$ alloys and have lower densities compared to the steels and commercial iron based alloys, offering better strength-to weight ratio. In addition, FeAl exhibits high electrical resistivity in the range of 130 to 170 $\mu\Omega$-cm as compared to many of the commercial metallic heating elements. These properties allow them to be considered as high temperature structural materials, gas filters, heating elements, and as fasteners. Iron aluminides have been prepared by a variety of methods including melting, roll compaction and mechanical alloying.

According to the present invention, FeAl or an alloy thereof is prepared by a sintering process. Sintering is useful for forming precision, high-performance products operating in demanding applications such as automotive engines, aerospace hardware, manufacturing tools and electronic components. Sintering delivers net shape processing, uses limited material, and eliminates deformation processing and machining of the components. It also allows microstructure control of the product. After shaping the powder into compacts, the compacts are heated to elevated temperatures (approximately one-half of the absolute melting temperature) to bond the particles and increase the strength.

The bonds between the particles grow by various mechanisms, which occur at the atomic level. Common mechanisms for metal bonding are solid-state diffusion and liquid state sintering (with liquid phase present during the process). Classical sintering processes include several stages: contact formation, neck growth, pore rounding and pore closure, and final densification of the product.

Many powder metallurgical processes use prealloyed powders as a starting mixture for dense intermetallic production, which can be obtained by atomization or mechanical alloying. Further consolidation (sintering) involves the use of complex and costly processes based on hot isostatic pressing or hot extrusion. Therefore, it would be desirable to develop low cost processing methods for intermetallic products. One approach is based on the use of elemental powders and pressureless sintering.

Due to the exothermic nature of an elemental iron and aluminum mixture, heating of the powders is accompanied by heat generation. A technique which involves initiation of an exothermic reaction between the mixed powders to form intermetallics and other inorganic materials is called Self-propagating High-temperature Synthesis (SHS) or combustion synthesis. It has been reported that the main disadvantage of this process is the large porosity of the final products. To eliminate porosity, some researchers have reported the use of the application of pressure during the combustion or sintering, which increases the complexity of the process.

According to the present invention, pressureless sintering behavior of Fe+Al powders was studied by monitoring the sintering stages of the process, i.e., temperatures at which expansion, shrinkage and phase transformation take place. Pressureless sintering is based on the thermal bonding of the particles into the solid structure without the assistance of the pressure and is widely used by automotive industry.

Elemental powders of Fe and 24 wt. % Al (corresponding to 40 at. % Al) were pressed as rectangular bars with the dimensions of 31.75×6.35×3 mm. No lubrication was involved in shaping process. Green densities used in this study were 77–87% of theoretical density (TD) of Fe—Al 24 wt. % (TD=6.06 g/cm$^3$). The powders were annealed Fe (−325 mesh, obtained from Hoeganaes), and 99.5% purity Al (−325 mesh, obtained from Goodfellow).

Expansion and shrinkage of the sample during sintering was monitored by dilatometry (Theta Industries Inc., N.Y.) and green samples and products of sintering were analyzed by X-ray powder diffraction (Scintag XDS-2000), and by optical and electron microscopy. A simultaneous differential scanning calorimeter (DSC) and thermogravimetric analyzer (TGA) from Netzsch was used for thermal studies. Sintered samples were chemically etched by Keller's reagent. Experiments were run in an argon atmosphere to a maximum temperature of 1350° C.

A series of experiments were carried out using powders of Fe and Al to investigate the mechanism of FeAl formation by DSC/TGA, and to determine the influence of the temperature and green density on the sintering behavior of FeAl products.

Figure 1B:
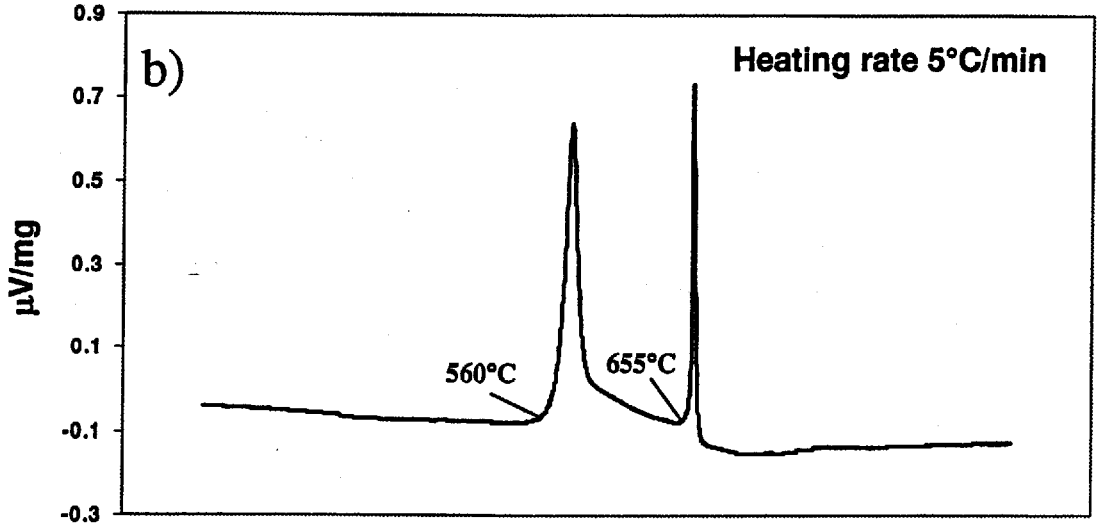
FIG. 1*b* shows differential scanning calorimetry (DSC) data for the pellet over the same temperature range.

FIG. 1*a* shows the thermal expansion curve of the Fe+Al pellet heated at a rate of 5° C./min (temperature range of 350–850° C). Dramatic expansion of the sample can be noticed at 560° C. FIG. 1*b* shows DSC data in the same temperature range as the expansion curve. Referring to the two exotherms in FIG. 1*b*, the onset of ignition as measured by DSC is at 560° C. for the first peak and 655° C. for the second peak. The first exothermic peak matches with the vertical line on the expansion profile. A second exothermic peak is at approximately the melting point of aluminum. No dimensional changes are observed in the thermal expansion curve corresponding to the second exothermic peak. Similar profiles were obtained by heating the Fe+Al pellet at 1, 2 and 10° C./min rate.

Figure 2:
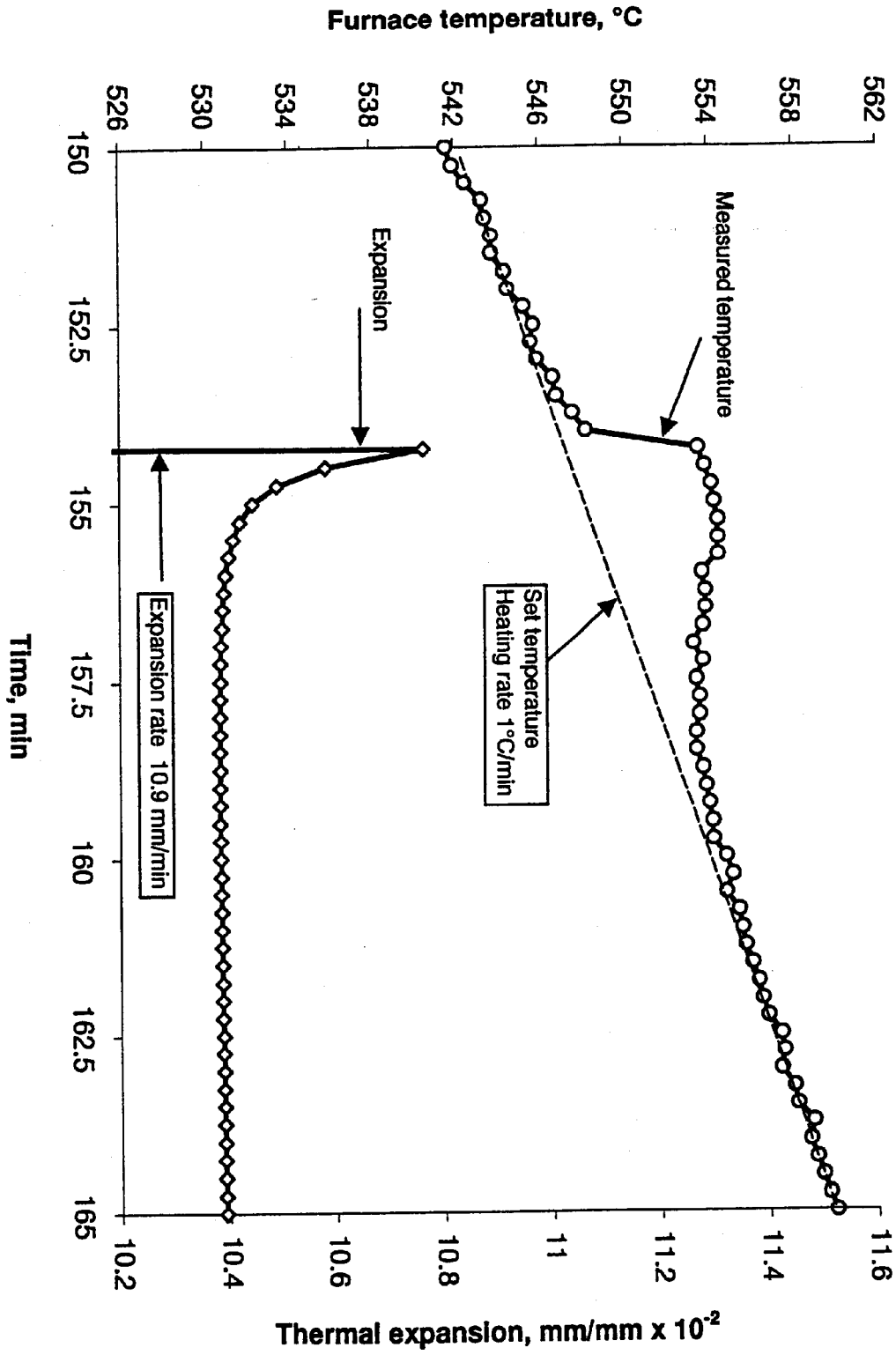
FIG. 2 shows a selected portion of a thermal expansion profile for a pellet of iron and aluminum powders heated at 1° C./min and a vacuum furnace temperature profile with a set temperature heating rate of 1° C./min.

The fact that the exothermic nature of the reaction occurred at ~560° C. can also be detected from dilatometric data. FIG. 2 shows the expansion profile and the temperature profile of an experiment performed at a heating rate of 1° C./min. The data plotted in FIG. 2 indicates that at the maximum expansion, the temperature of the sample was higher than the set temperature of the furnace. Because of the exothermic nature of the Fe+Al reactions, it is believed that the dramatic increase in sample expansion is due to the exothermic reaction occurring between Fe and Al powders. The rapid decrease in the expansion may be associated with the fast cooling of the sample back to the furnace temperature after the exothermic reaction. However, the expansion rate was very high, 10.9 mm/min.

X-ray analysis at different stages of the overall reaction confirms that the first exotherm is primarily due to the formation of $Fe_2Al_5$. The reaction produces an aluminum rich intermetallic and leaves unreacted Fe. The second exotherm is primarily due to the formation of FeAl by reaction of $Fe_2Al_5$ with Fe. Further increase in temperature leads to formation of only FeAl (~1000° C.).

Figure 3:
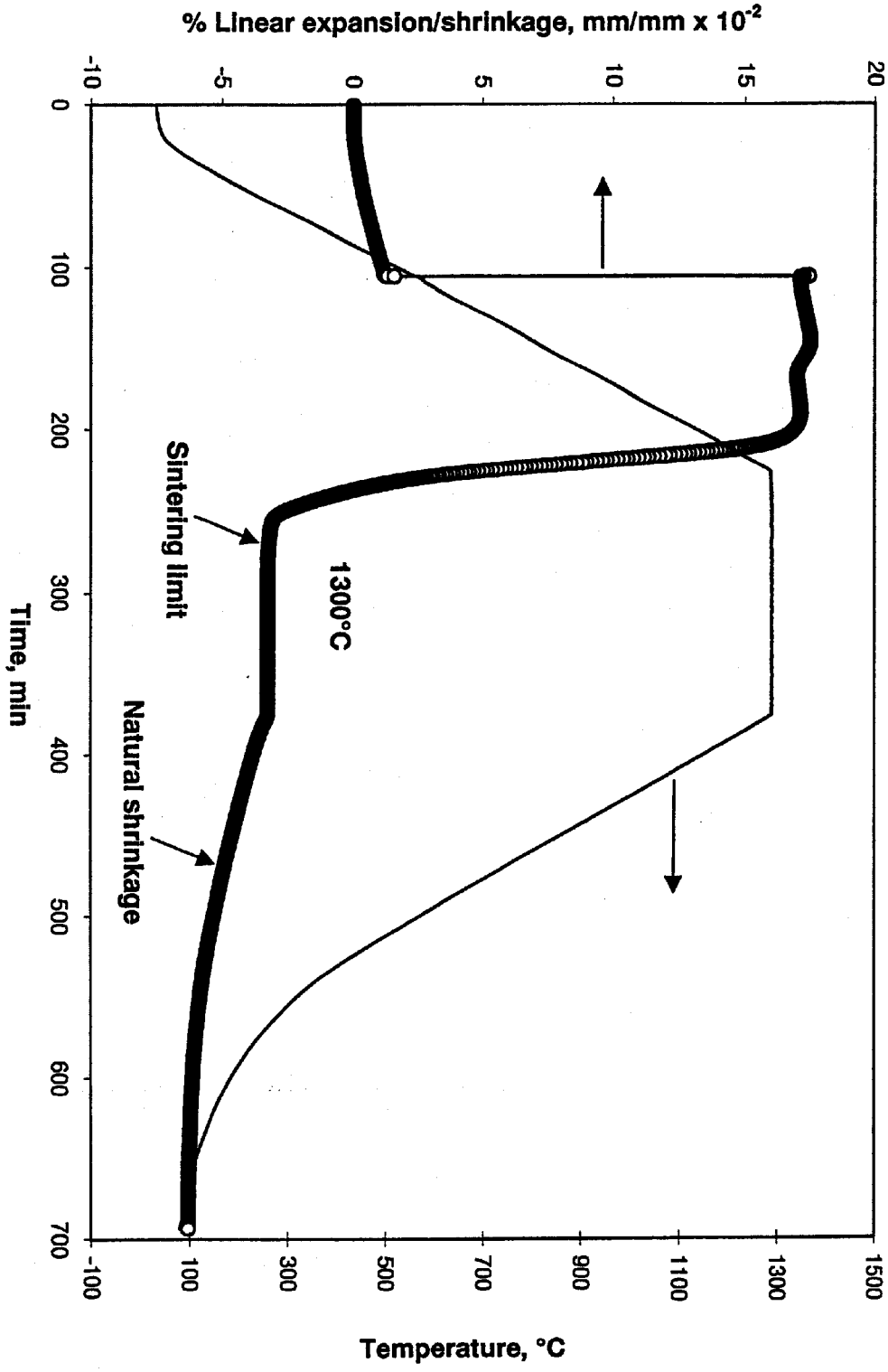
FIG. 3 shows a thermal expansion profile for a pellet of iron and aluminum powders heated at 5° C./min and a vacuum furnace temperature profile with a set temperature heating rate of 5° C./min up to 1300° C.

FIG. 3 shows the expansion/shrinkage and temperature profiles of an experiment carried out at 5° C./min with a 2.5 hour hold at 1300° C. Significant shrinkage was observed after reaching a temperature of 1200° C., and the shrinkage reached its limit before reaching a temperature of 1300° C. Holding the sample at 1300° C. for 2.5 hours did not lead to any further shrinkage or sintering as evidenced by the horizontal profile in FIG. 3. Cooling of the sample led to natural shrinkage of the FeAl sample. Densities obtained during experiments at heating rates from 1 to 10° C./min were in the range of 86.5–89.8% of theoretical density. A maximum linear expansion of ~18% was observed in the heating range of 1 to 10° C./min.

Figure 4:
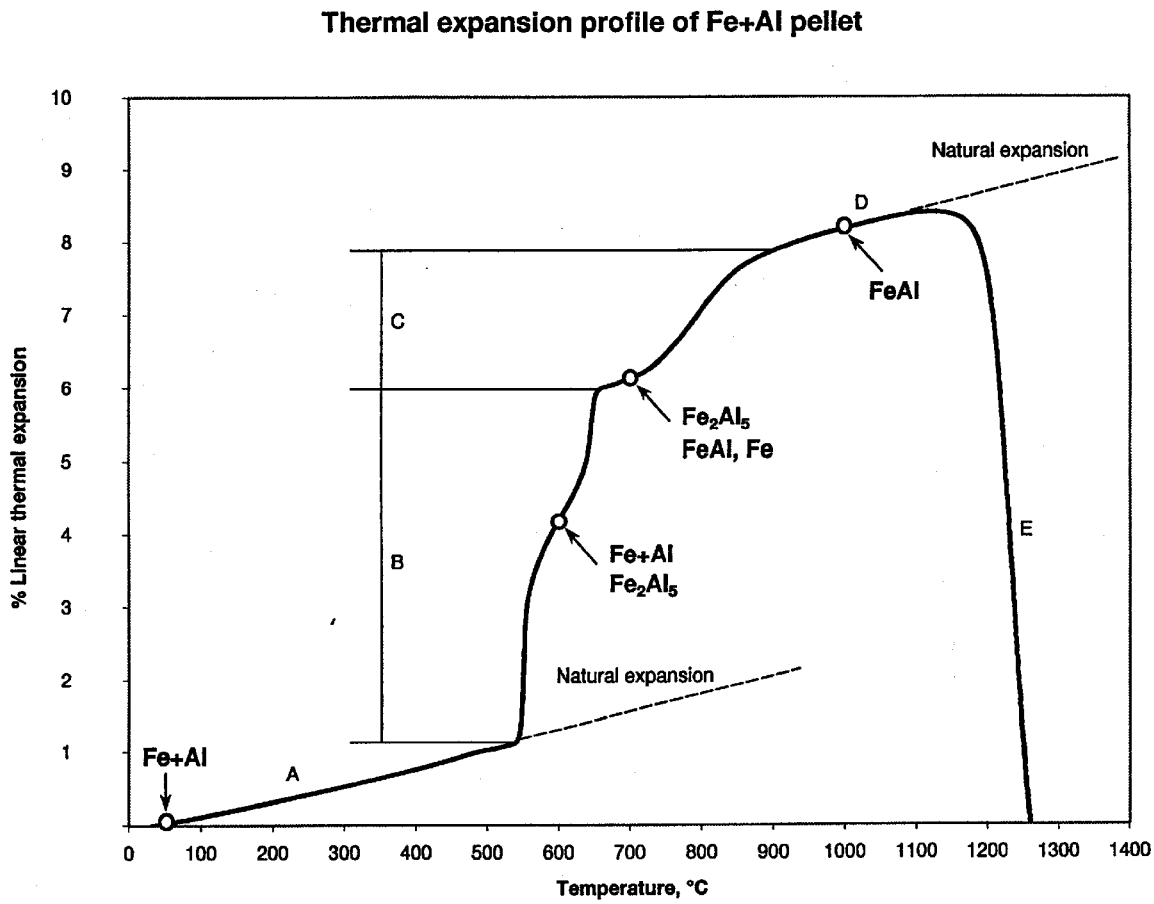
FIG. 4 shows a thermal expansion profile for a pellet of iron and aluminum powders heated at 0.5° C./min.

The thermal expansion curve of a pellet sintered at a heating rate of 0.5° C./min is shown in FIG. 4. However, unlike FIG. 3, FIG. 4 exhibits a non-linear expansion with increase of temperature in the range of 30 to 1100° C. Expansion is linear from room temperature to 520° C., designated as region "A". It is believed that this is due to natural expansion of the Fe+Al mixture. The sample dramatically expands from 550° C. onwards (as shown by vertical line) and reaches 3% of linear expansion. After that, a small shrinkage is followed by another dramatic expansion, designated as region "B". At 655° C., which is very close to the melting point of aluminum and the eutectic temperature, shrinkage starts again followed by natural expansion, designated as regions "C" and "D". Starting from 1200° C., a sharp drop of the expansion curve is observed, designated as region "E".

In order to investigate the mechanism of simultaneous reaction synthesis, experiments were performed under the same conditions as in the case of the thermal expansion curve showed in FIG. 4. However, the experiment was interrupted at 500° C., 600° C., and at 1000° C. The product obtained after each experiment was characterized by X-ray diffraction, optical microscopy and SEM.

Figure 5:
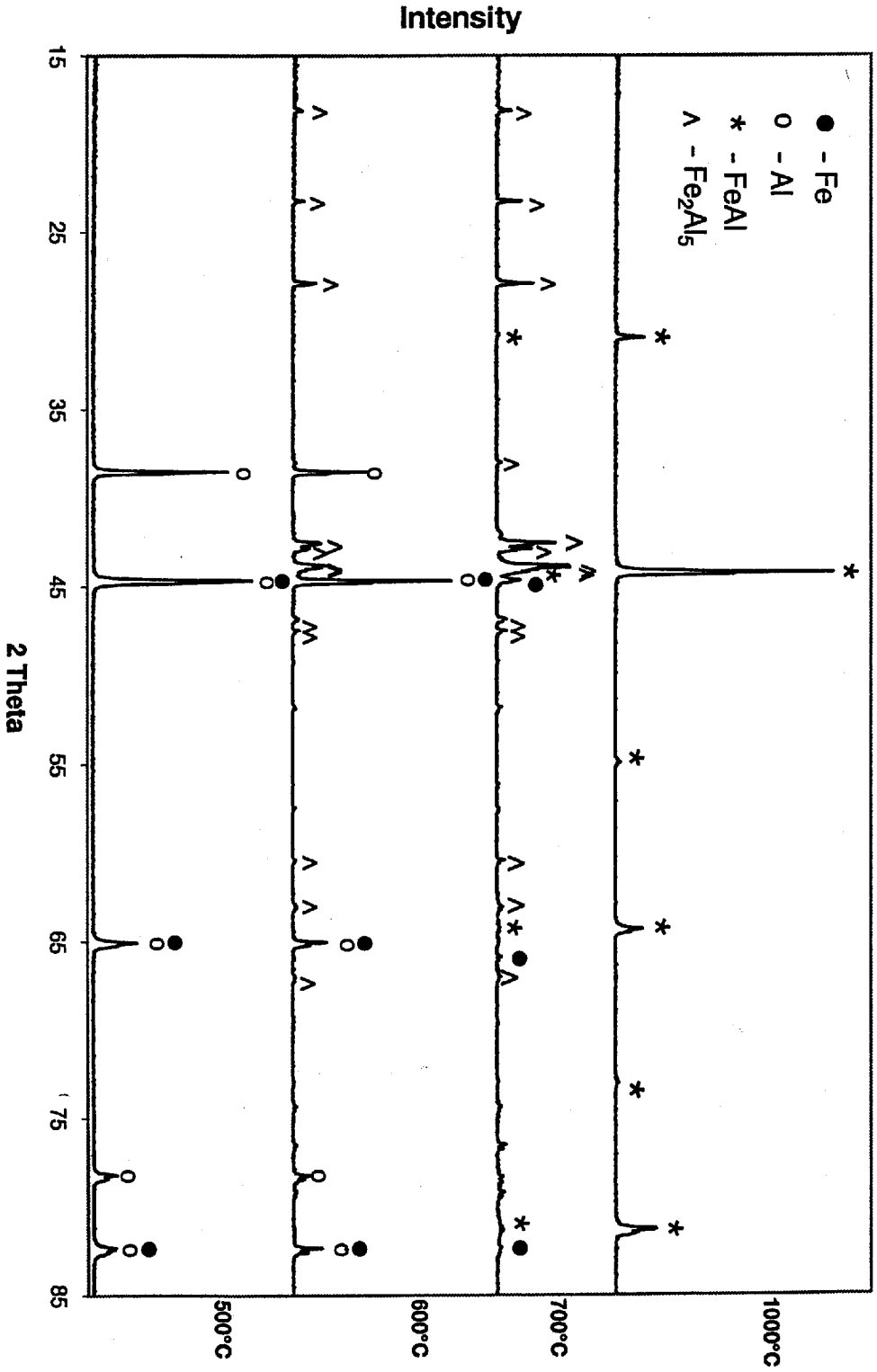
FIG. 5 shows X-ray diffractograms of samples of iron and aluminum powders interrupted at various temperatures using a heating rate of 0.5° C./min.
Figure 6A:
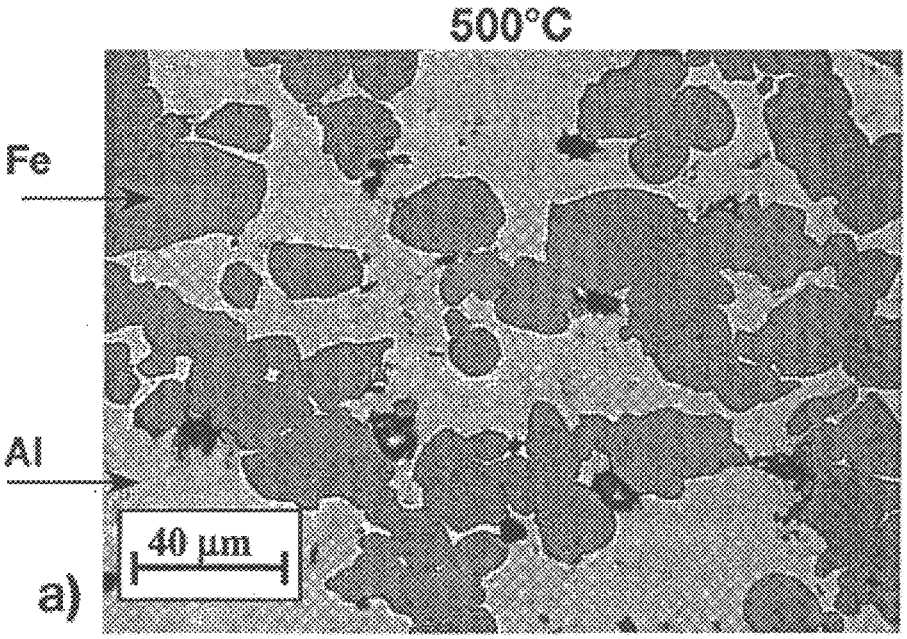
FIGS. 6*a–d* show photomicrographs of samples of iron and aluminum powders interrupted at various temperatures using a heating rate of 0.5° C./min.
Figure 6B:
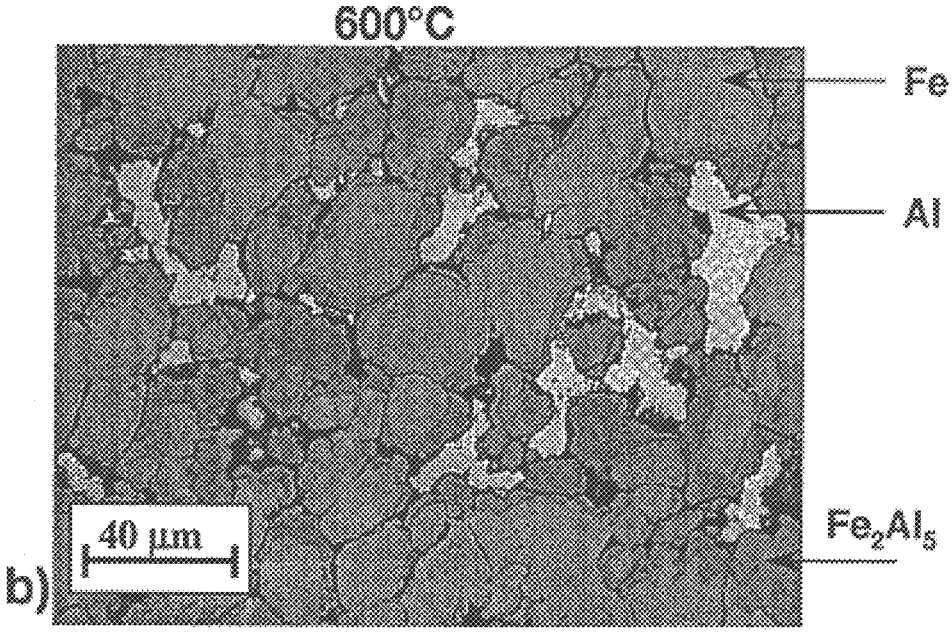
Figure 6C:
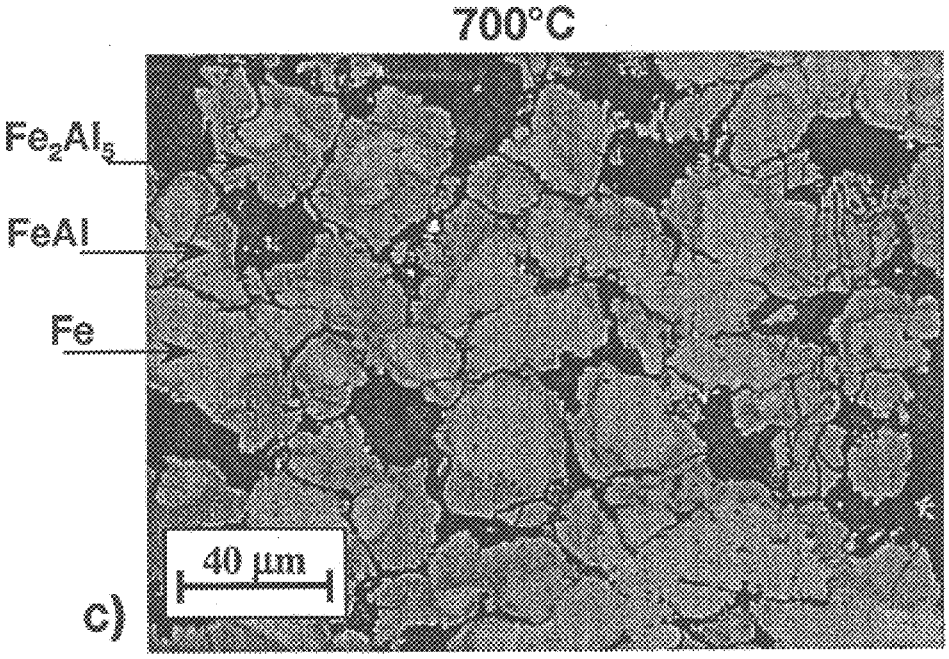
Figure 6D:
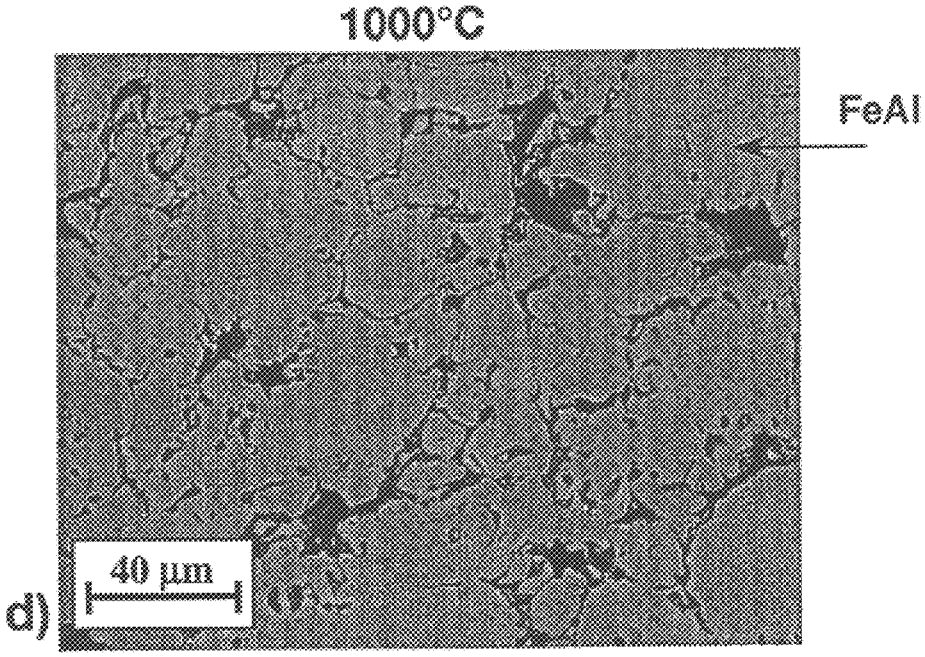

X-ray diffractograms of samples heated to various temperatures and quenched are shown in FIG. 5, which provides an analysis of the reactions occurring during the synthesis/sintering steps. As shown, a sample after heating to 500° C. contained Fe and Al phases as were present in the initial green sample. The $Fe_2Al_5$ phase was observed to occur after heating to 600° C. After the free aluminum melts, FeAl was observed to occur after heating to 700° C. At that point there is no free aluminum left and all of the aluminum is combined into the aluminum rich phase $Fe_2Al_5$. In addition, FeAl coexists with $Fe_2Al_5$ and free iron. Further heating to 1000° C. results in completely reacting the free iron and the $Fe_2Al_5$ to form 100% FeAl. After reaching the 1150° C., the sample starts shrinking with increasing temperature. Samples quenched at 500, 600 and 700° C. showed ferromagnetism, which is explained by the presence of free iron in the product.

Figure 7:
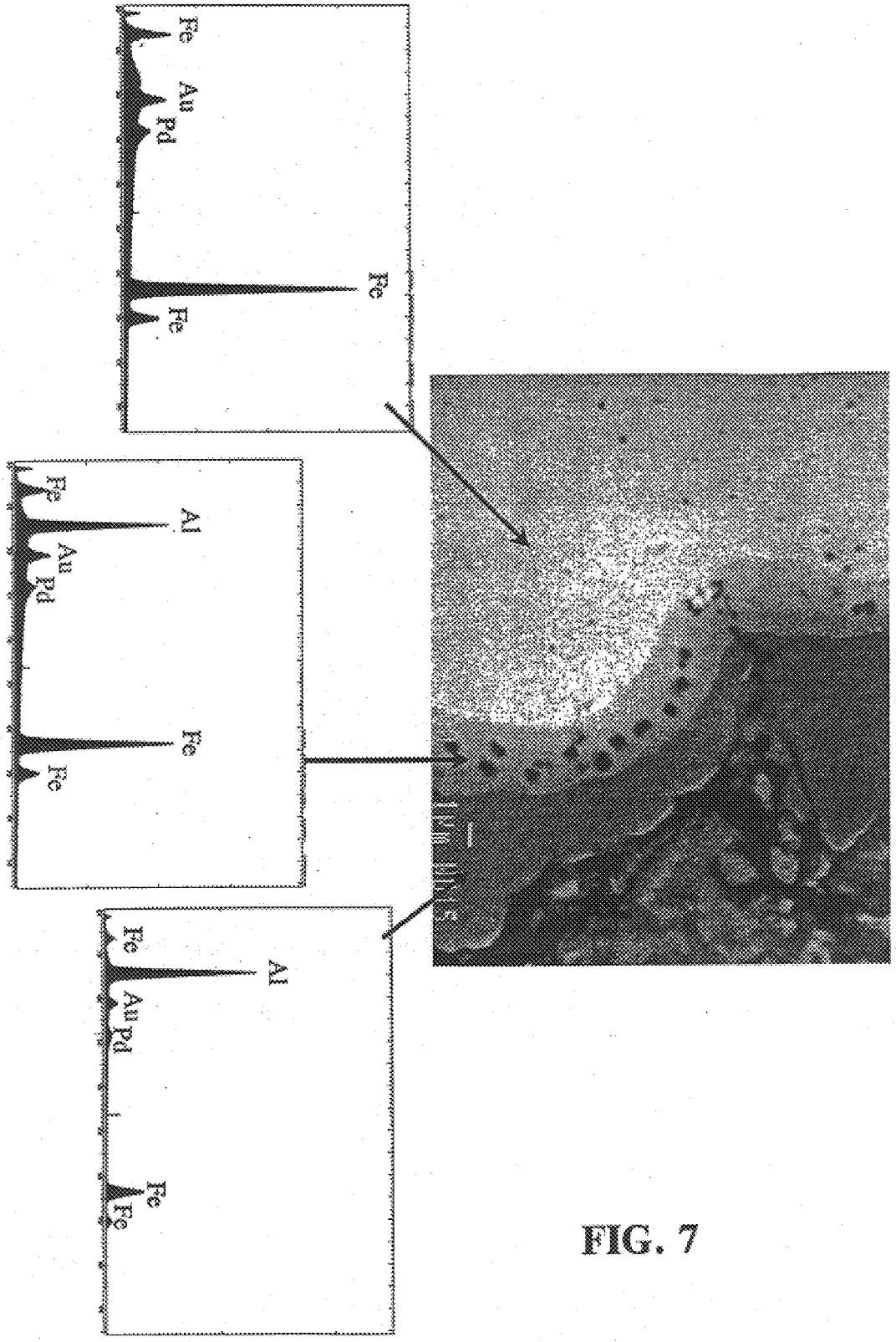
FIG. 7 shows a photomicrograph and EDX spectra of a samples of iron and aluminum powders interrupted at 700° C.
Figure 8A:
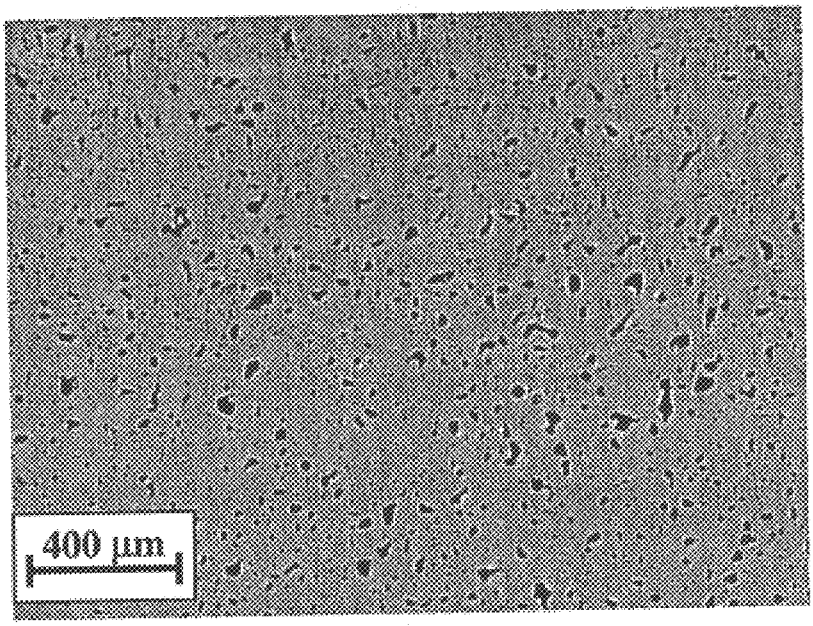
FIG. 8*a* shows a photomicrograph of an unetched sample.
Figure 8B:
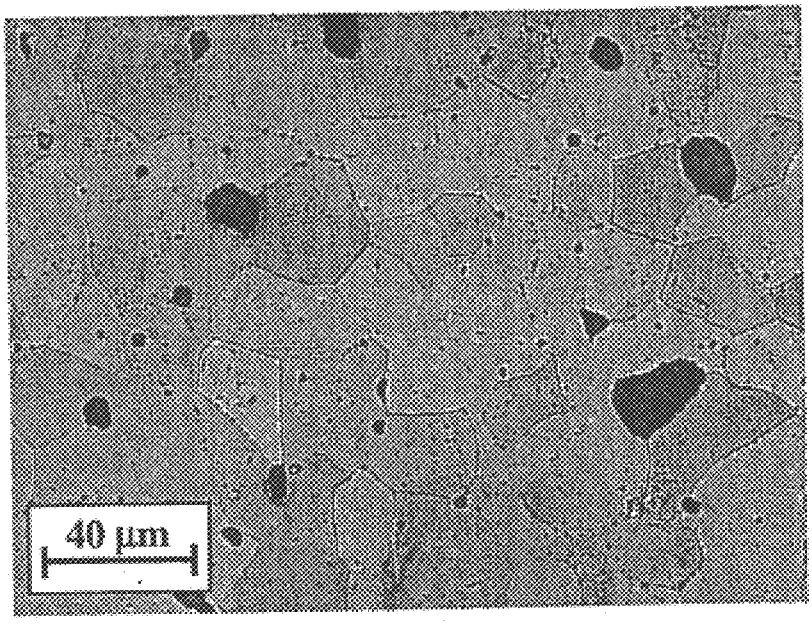
FIG. 8*b* shows a photomicrograph of an etched sample sintered at 1250° C. for 3 hours.

To determine the extent of sintering and the residual porosity, the samples were observed under an optical microscope in the polished and unetched condition. It was found that the green pellet was a highly pressed Al and Fe powder mixture having a density of 5.3 g/cm$^3$ which corresponds to a 87% theoretical density (Fe—Al 40 at %=6.06 g/cm$^3$). FIGS. 6*a*, 6*b*, 6*c*, and 6*d* show microstructures of pellets heated to different temperatures and quenched. The sample quenched from 500° C. (FIG. 6*a*) shows 2 phases wherein the dark phase is identified as Fe and light phase is identified as Al. This confirms that no phase changes occur from room temperature to 500° C. except for natural thermal expansion as shown in FIG. 4 of the thermal expansion profile. The sample quenched from 600° C. (FIG. 6*b*) shows 3 phases wherein X-ray analysis indicates that the phases are Fe, Al, and $Fe_2Al_5$. Using Energy Dispersive Spectroscopy (EDS), the phases where identified as: lightest- Al, darkest - Fe and phase surrounded by iron- $Fe_2Al_5$. By volume, the Fe+Al mixture should contain approximately equal amounts of both elements (Fe-52Vol % and Al-48Vol %). As can be seen from FIG. 6*b*, the amount of aluminum is less than the amount of iron, which agrees with X-ray diffraction and EDS data (formation of aluminum rich phase). According to X-ray analysis, whereas three phases should be present at 700° C., namely, $Fe_2Al_5$, FeAl, and Fe, only two contrasting phases appear by optical microscopy in FIG. 6*c*. However, higher resolution image obtained by SEM (FIG. 7) shows three phases, which differ in contrast. The EDS spectrum obtained from these regions indicate that between the Fe and aluminum rich phase ($Fe_2Al_5$) there is a layer with equal amounts of Fe and Al, i.e., a phase believed to be FeAl. Au and Pd peaks present on the spectra are due to the Au-Pd coating of the specimen for SEM observation. At this stage, aluminum has melted and diffused to form the $Fe_2Al_5$ and FeAl phases, leaving the large pores. At 1000° C., the pellet reached nearly the maximum thermal expansion point (8.5%) and represents 100% FeAl, FIG. 6*d*. As a result of shrinkage that starts at 1150° C. and intensifies at 1200° C., the density of the material reaches 94.5% TD. FIG. 8*a* shows an unetched microstructure and FIG. 8*b* shows an etched microstructure of a sample sintered at 0.5° C./min heating rate. As shown, pores are isolated and have a substantially spherical shape. Etching reveals the grain structure of the sintered material with an average grain size of about 25 $\mu$m.

Figure 9:
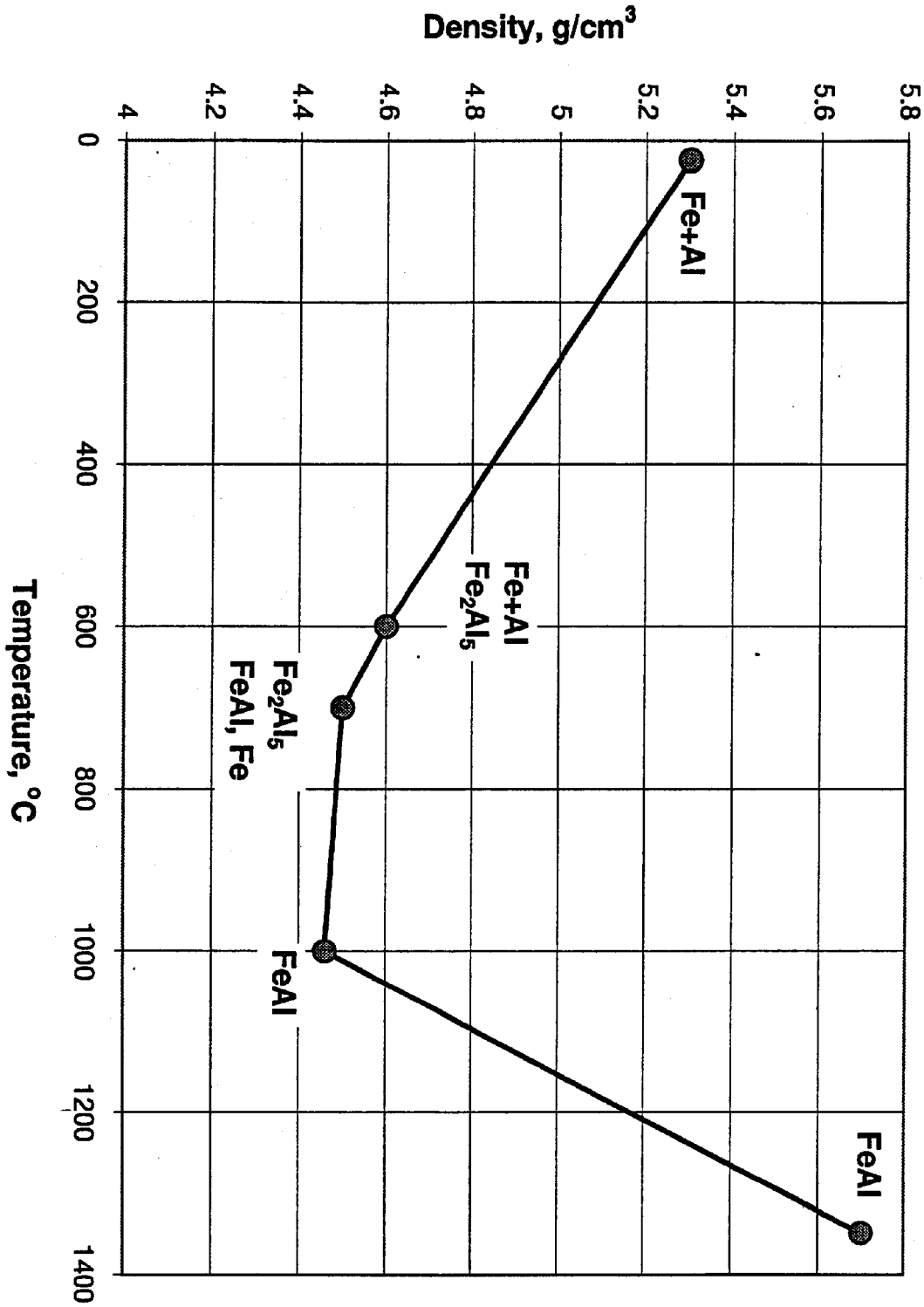
FIG. 9 is a graph showing sample density as a function of temperature at which heating is interrupted.

Density measurements of material quenched at early stages of synthesis/sintering showed a decrease in density with temperature increase. After complete conversion to the desired FeAl phase, densification begins and peaks at about 5.73 g/cm$^3$, FIG. 9.

Figure 10:
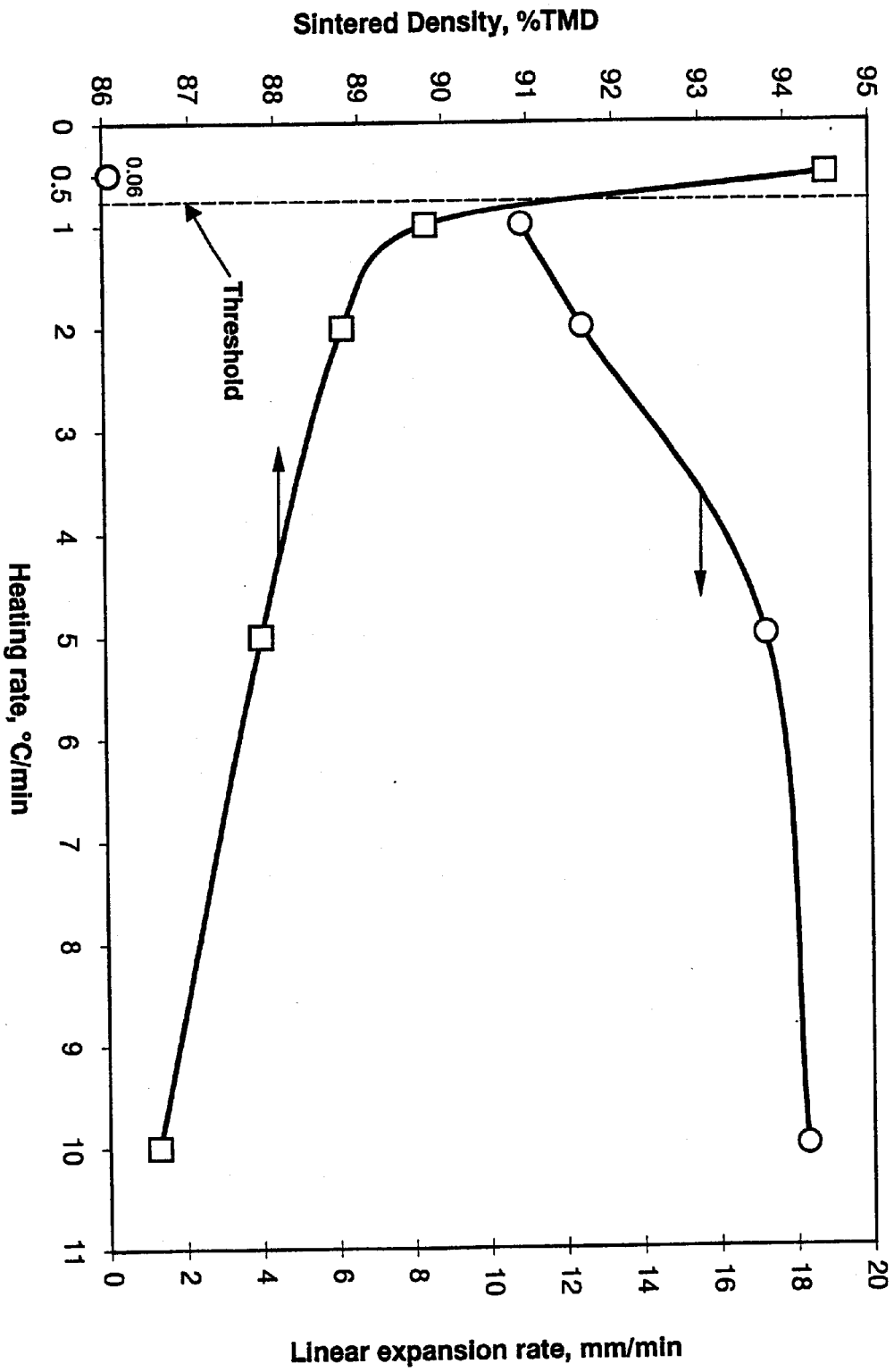
FIG. 10 is a graph showing sample density and linear expansion rate during a first exothermic reaction of the iron and aluminum as a function of various heating rates.

The expansion profiles from the experiments performed at higher heating rates of 1, 2, 5 and 10° C./min are different from the profiles obtained at a low heating rate of 0.5° C./min. The expansion rate during the first reaction (520–560° C.) and the final sintered density of materials obtained at various heating rates were also different, as shown in FIG. 10 which includes a threshold line between the 0.5 and 1° C./min heating rates. A surprising and unexpected property is the linear expansion rate (0.06 mm/min) of the sample at ~560° C. in the case of the 0.5° C./min heating rate which is 180 times lower than the lowest rate obtained during heating >1° C./min. Another unexpected property is the sintered density of the sample heated at 0.5° C./min which reached 94.5% TD compared to the maximum density of about 90% for the samples heated at 1° C./min and above.

Figure 11:
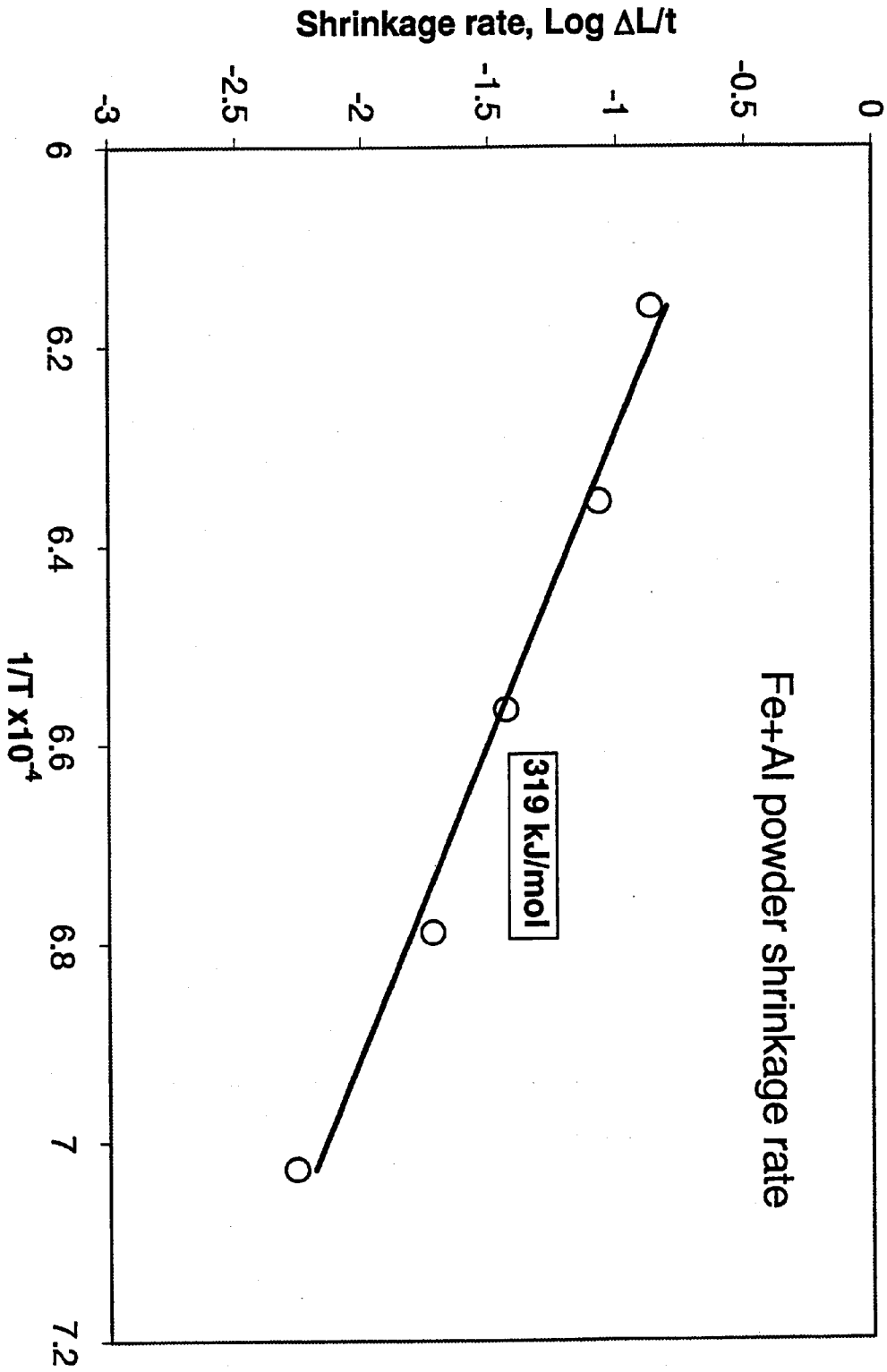
FIG. 11 is a graph of activation energy for sintering FeAl calculated from the shrinkage rate.

In order to determine the activation energy of sintering, sintering experiments were carried out at different temperatures for a fixed interval of 1 hour. FIG. 11 shows the Log of shrinkage rate with 1/T where T is the holding temperature. The activation energy is in the order of 319 kJ/mol.

Several experiments were performed using samples with lower green density (77%). Regardless of the density, synthesis/sintering patterns were similar to the high green density (87%) samples for all heating rates. Some shift in temperature at which expansion starts was observed at different heating rates. At higher heating rates, expansion was found to begin at higher temperatures. Generally, lower green density samples resulted in lower sintered density.

From the experimental results, it has been determined that the heating rate influences the reaction mechanism of the compound formation in the Fe—Al (40 at %) system. For instance, higher heating rates decrease the tendency of formation of pre-combustion phases due to less solid state interdiffusion. This results in larger amounts of liquid formed during combustion reactions and leads to synthesized products having lower porosity. The present invention provides a technique for obtaining less porosity and higher density in the final FeAl product.

Figure 12:
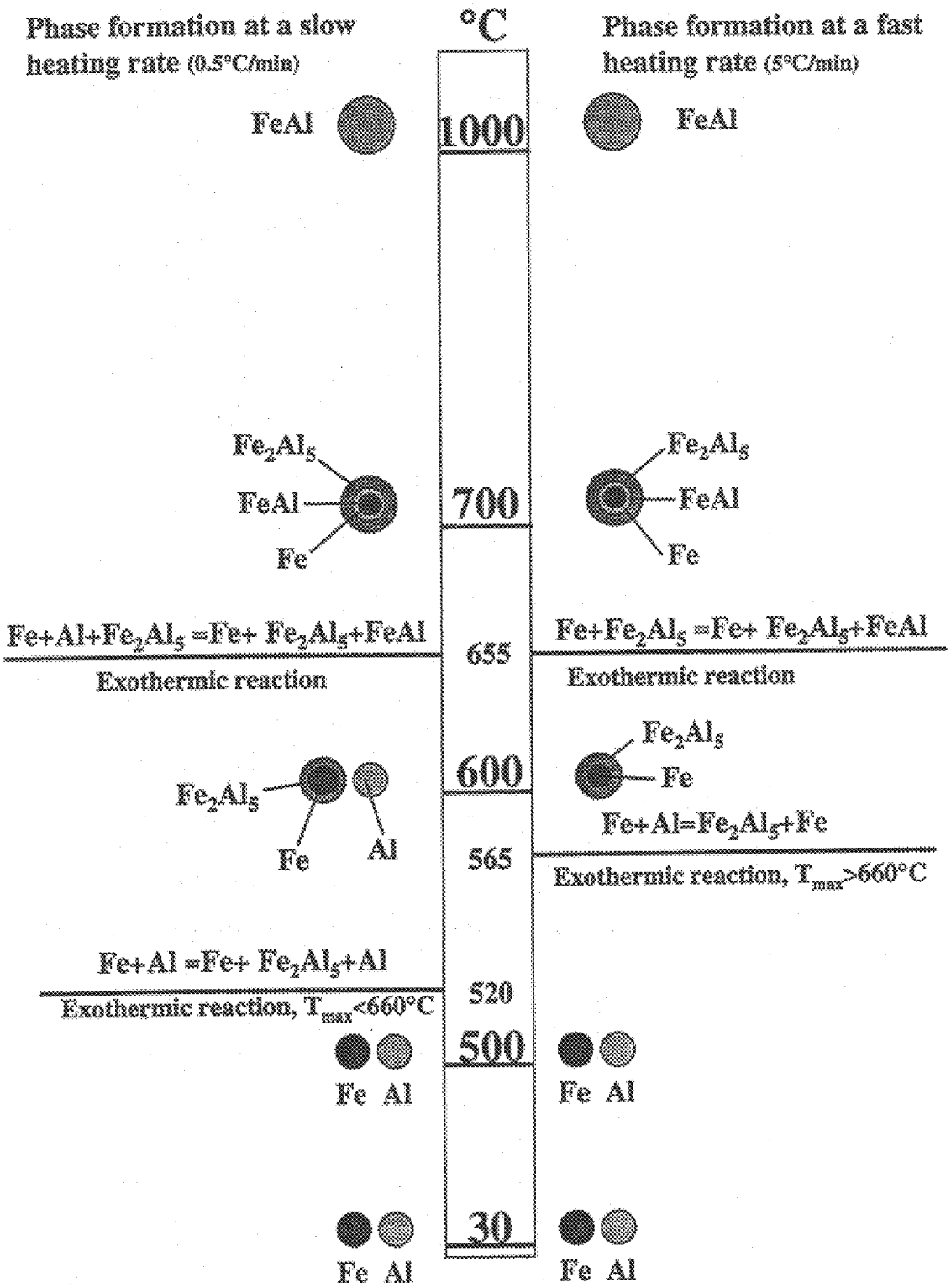
FIG. 12 is a schematic diagram of FeAl formation during heating of elemental powders of iron and aluminum from room temperature to 1000° C. at slow and fast heating rates.

FIG. 12 shows a schematic diagram of reaction sequences using slow heating rates and fast heating rates. As shown on the left side of FIG. 12, using a heating rate of 0.5° C./min, the reaction starts at ~520° C. with the formation of the aluminum rich $Fe_2Al_5$ phase. Formation of aluminum rich compound is predicted by the heat of formation of the $Fe_2Al_5$, which has been reported to be −34.3 kcal mol$^{-1}$. The heat generated by this reaction is not enough to induce the melting of aluminum, as shown by the microstructure presented in FIG. 6*b*. Microscopic examination and x-ray analysis showed evidence of a $Fe_2Al_5$ layer growing around the Fe particles by solid state diffusion of Al.

The second reaction occurs near the melting point of aluminum (655° C.). At this point aluminum completely melts and diffuses into the iron. The result of the interfacial reaction between Fe and $Fe_2Al_5$ is the formation of the desired phase FeAl. This reaction can be accompanied by the formation of voids which provide an escape path for volatile impurities present in the original powder, as shown in FIG. 7.

After formation of a small amount of FeAl phase, the dominant process is solid state diffusion. At 1000° C., formation of the desired FeAl phase is completed. Both exothermic reactions and diffusion process were accompanied by the expansion of the sample up to 8.5% (linear). Swelling of the compact continues up to 1150° C. followed by the sintering.

In the case of fast heating (1–10° C./min), as shown on the right side of FIG. 12, the reaction sequence is different. First, the exothermic interaction between Fe and Al occurs at ~565° C. according to the reaction $Fe+Al=Fe_2Al_5+Fe$. However, free aluminum is not present in the mixture after this reaction. The microstructure is similar to the microstructure obtained at 700° C. for the 0.5° C./min heating, but without FeAl phase and with larger pores. The ignition temperature of the second exothermic reaction is dictated by the eutectic temperature of the Fe—Al system (655° C.). Microscopic observations revealed rings of the FeAl around the iron particles at the Fe and $Fe_2Al_5$ interface. Expansion of the sample was not observed during the second exothermic reaction, as shown in FIG. 1. After that point, the process of FeAl formation is similar to the case with the low heating rate and at 1000° C., formation of FeAl is completed.

As discussed above, swelling of compacts in the Fe—Al system is a major obstacle for producing dense intermetallic materials for commercial applications. As shown in the following Table, the density of the $Fe_2Al_5$ compound is much lower than the density of an Fe+Al (24 wt. %) mixture and FeAl.

| | Aluminum at % (wt %) | Density (g-cm$^{-3}$) | Melting Point (° C.) | Heat of Formation (ΔH) | Crystal structure |
|---|---|---|---|---|---|
| Fe | | 7.86 | 1538 | | BCC |
| Al | | 2.7 | 660 | | FCC |
| FeAl | 40(24) | 6.06 | 1370 | −12.0 | BCC |
| $Fe_2Al_5$ | 71.4(54.7) | 3.96 | 1171 | −34.3 | Orthorhombic |
| Fe + Al | 40(24) | 5.39 | | | |

Figure 13:
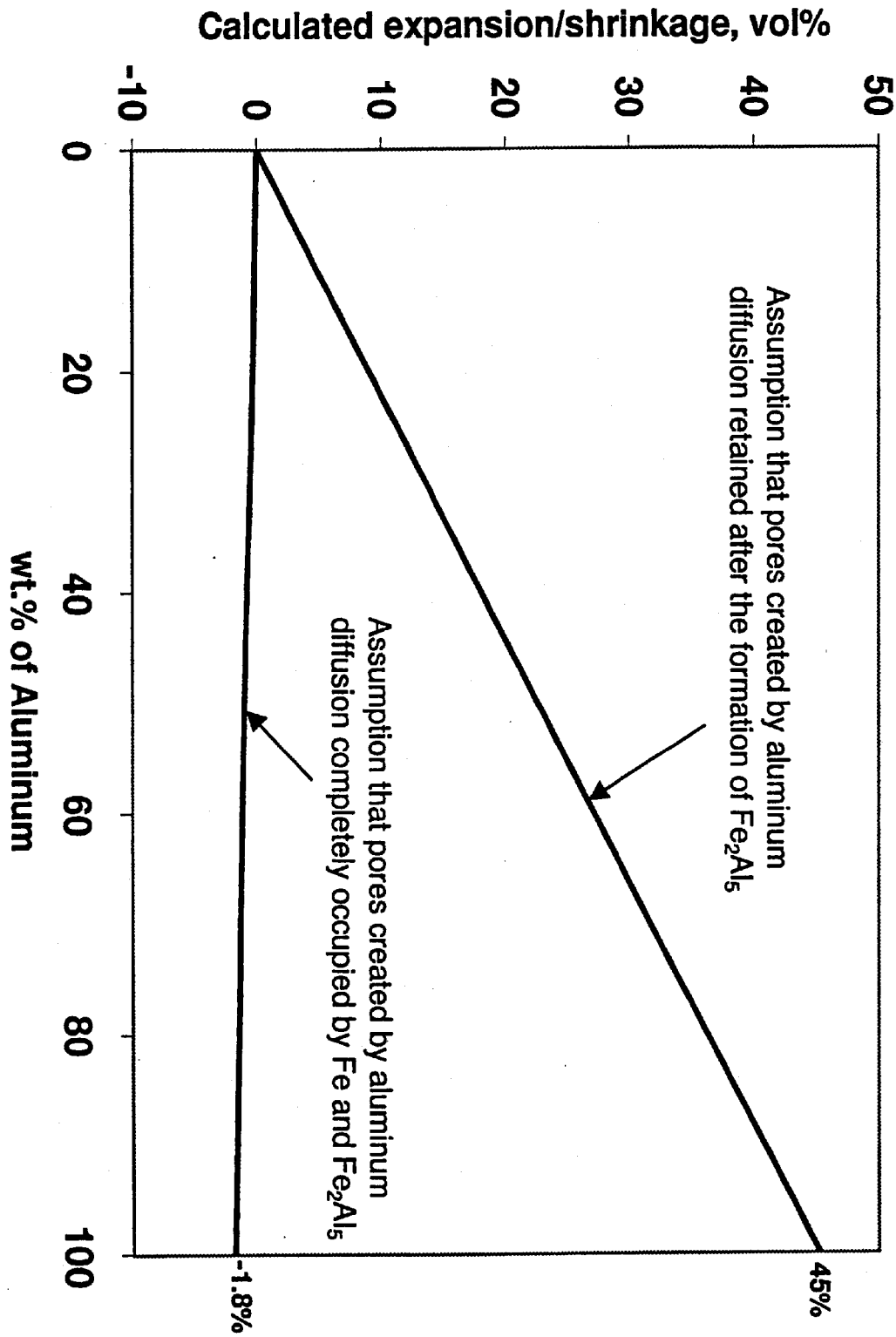
FIG. 13 is a graph of calculated dimensional change dependence of the sample on the amount of aluminum diffused into iron to form $Fe_2Al_5$.

FIG. 13 shows calculated expansion/shrinkage vol % dependence on the weight percent of aluminum, which diffused, into iron to form only $Fe_2Al_5$. The upper plot in FIG. 13 is calculated with the assumption that pores previously occupied by aluminum remained unfilled whereas the lower plot is calculated with the assumption that pores previously occupied by aluminum are completely filled with Fe and $Fe_2Al_5$. In the latter case, if all (100%) aluminum is utilized, 1.8% volume shrinkage should occur. In the worst case, the volume expansion can reach up to 45%. In the experiments, neither of these cases was observed. Instead, a partial filling of the pores occurs because of the outward diffusion of aluminum along with the pushing of the particles apart due to the volume expansion. In these calculations, the initial porosity of the green compact was taken in consideration.

The first exothermic reaction discussed above can be manipulated to provide minimal volume expansion by controlling the heating rate during the reaction to be in a desirable range, such as, for example, less than 1° C./min for the alloy composition and powder sizes used in the study. However, the same result can be achieved at different heating rates for different alloy compositions and/or sizes of the powder used to form the powder mixture. For example, for smaller powder sizes a slower heating rate could be used such as, for example, 0.1 to 0.5° C./min and for larger powder sizes a faster heating rate could be used such as, for example, 0.5 to less than 5° C./min.

During the fast heating rate, it is believed that the $1^{st}$ rapid exothermic reaction between Fe and Al raises the temperature higher than the melting point of aluminum (660° C.) with the result that the liquid phase quickly diffuses into the iron through capillary action. Consequently, large pores are left at the sites previously occupied by aluminum. Because of the volume difference between $Fe_2Al_5$ and Fe, iron particles covered by freshly formed $Fe_2Al_5$ push each other apart and at the same time refill the pores left by aluminum. It is also possible that the aluminum melt penetrates along the interparticle junctions and causes particle separations. This results in an overall volume expansion of the compact.

The second reaction between Fe and $Fe_2Al_5$ does not significantly affect the dimensions of the compact due to the fact that there is only a minor amount of FeAl formed at the interface of Fe and $Fe_2Al_5$. The further slow diffusion process continues without significant changes in dimension up to 1150° C.

During the slow heating, the $1^{st}$ reaction starts at a lower temperature and the combustion temperature did not exceed the melting point of aluminum. The $Fe_2Al_5$ phase around the iron particles is formed in a slow reaction (~5 minutes) followed by prolonged diffusion process of Al into the iron. It is believed that, at this point, the $Fe_2Al_5$ phase already occupies some volume left by the diffused aluminum. At 655–660° C., melting of Al triggers the $2^{nd}$ exothermic reaction which results in a complete disappearance of Al but with less dramatic expansion followed by slow diffusion towards complete FeAl formation (similar to the high heating rate case).

Experimental results show that one of the important parameters in pore-free synthesis of FeAl is the ratio between the expanded volume $-V_e$ (induced by particles pushing each other) and shrinkage volume $V_s$ (created by pore refilling). Based on the experimental observations and volume calculations, it is proposed that for the described experimental conditions in the Fe-24 wt. % Al system:

$$V_e/V_s \text{ (slow heating)} < V_e/V_s \text{ (fast heating)}$$

Where, slow heating is ≦0.5° C./min and fast heating is ≦1° C./min.

During FeAl synthesis, because formation of the intermediate phase cannot be avoided, it is desirable to keep the ratio $V_e/V_s$ very low, which might be possible by reducing the particle size of the initial components or by introducing prealloyed FeAl as an additive.

After synthesizing of 100% FeAl, the next step is the densification of the compacts involving diffusion, which is driven by a reduction of the surface area. Final densification of the samples depends on the expansion, which occurs prior to the complete formation of FeAl. In the case of high heating rates, the linear expansion of the compact is 15–18%, whereas the low heating rate leads to the 8.5% expansion. Samples with linear expansion of ~18% can only be sintered up to 87% TD for Fe—Al 24% wt., whereas samples with 8.5% expansion can be consolidated with the density up to 94.5%. In both cases, densification starts at 1150° C. and rapidly increases from 1200° C.

Experiments carried out at various sintering temperatures confirmed that the sintering limit can be achieved faster at higher (e.g., 1350° C.) temperatures. The same densification can be obtained at the lower temperatures (e.g., 1200° C.), but with longer heating times. Accordingly, high temperatures on the order of 1200–1350° C. can be used to achieve ~95% densities under pressureless sintering.

One of the challenges in Fe—Al sintering is to reduce the large pores left by diffusion of aluminum. The microstructures of the FeAl samples in FIGS. 8*a* and 8*b* show isolated and roundish morphology of the pores at the grain boundaries and the interior of the grains with few of them connected to each other. According to sintering theory, early in the sintering process the pores remain attached to the grain boundaries and as the temperature increases the rate of grain boundary motion increases. After isolation of the pores from each other and further shrinkage, the grain boundaries break away from the pores leaving them trapped in the interior of the grains. Generally, pores at the grain interior shrink much slower than pores on the grain boundary. Separation of the pores from the boundaries thus limits the final density. As such, it is desirable to avoid the formation of pores inside the grains. According to the present invention, pore formation and location can be controlled during the densification process.

According to the present invention, it is possible to produce highly dense FeAl intermetallic articles by a pressureless sintering technique wherein a mixture of elemental iron and aluminum powder is exothermically reacted to produce the FeAl intermetallic compound. In the preferred process, the sintering behavior of the powder can be controlled by using a heating rate which minimizes the expansion rate during the exothermic reaction of forming $Fe_2Al_5$.

The sintering process according to the invention can be used to make various products such as high precision and/or high performance products for applications in automotive, aerospace, electronics, industrial tool, power generation, or other industries. The sintering process can be used to make net shaped articles while minimizing waste material and/or eliminating costly post-sintering machining operations.

While the invention has been described in detail with reference to specific embodiments thereof, it will be apparent to those skilled in the art that various changes and modifications can be made, and equivalents employed, without departing from the scope of the appended claims.

What is claimed is:

1. A method of manufacturing an iron aluminide intermetallic alloy composition by a powder metallurgical technique, comprising steps of:

forming a powder mixture comprising elemental aluminum powder and elemental iron powder;

heating the powder mixture so as to react the aluminum powder and the iron powder to form a first reacted compact containing $Fe_2Al_5$, free-aluminum and free-iron;

heating the first reacted compact such that at least some of the free-aluminum melts and reacts with the free-iron and/or the $Fe_2Al_5$ to form a second reacted compact containing FeAl, $Fe_2Al_5$ and free-iron; and heating the second reacted compact so as to react the free-iron with the FeAl and/or the $Fe_2Al_5$ to form a sintered compact containing FeAl.

2. The method of claim 1, wherein the heating steps are carried out in a vacuum or inert gas environment.

3. The method of claim 1, wherein the $Fe_2Al_5$ is formed by a solid state reaction without melting the aluminum powder.

4. The method of claim 1, wherein expansion of the first reacted compact due to volume change during formation of the $Fe_2Al_5$ is less than 10%.

5. The method of claim 1, wherein the aluminum powder is completely melted during formation of the FeAl.

6. The method of claim 1, wherein expansion of the second reacted compact due to volume change during formation of the FeAl is less than 10%.

7. The method of claim 1, wherein the FeAl initially forms as a layer between the iron powder and the $Fe_2Al_5$.

8. The method of claim 1, wherein expansion of the sintered compact due to volume change during formation of the FeAl is less than 10%.

9. The method of claim 1, wherein the powder mixture is heated at a heating rate of less than 1° C./min at least during the step of reacting the aluminum powder with the iron powder to form the first reacted compact.

10. The method of claim 1, wherein the sintered compact is heated sufficiently to increase the density of the sintered compact to over 90% of the theoretical density.

11. The method of claim 1, further comprising pressing the powder mixture into a shaped article.

12. The method of claim 1, wherein during the heating steps the following reactions sequentially occur:

$Fe_2Al_5$ is formed as a layer around the individual particles of the iron powder without melting of the aluminum powder;

the aluminum powder melts and diffuses into the iron powder;

some of the FeAl is formed by an interfacial reaction between the iron powder and the $Fe_2Al_5$;

the balance of the FeAl is formed by a solid state diffusion.

13. The method of claim 1, wherein the powder mixture comprises water, gas or polymer atomized powder and the method further comprises a step of sieving the powder and blending the powder with a binder prior to the forming step, the binder providing mechanical interlocking of individual particles of the powder during the forming step.

14. The method of claim 1, wherein the heating steps include heating the second reacted compact at a temperature of 1200 to 1350° C. in a vacuum or inert gas atmosphere.

15. The method of claim 1, wherein the sintered compact has a grain size of 1 to 50 μm.

16. The method of claim 1, wherein the step of forming the powder mixture comprises mixing iron powder and aluminum powder having an average particle size of 1 to 200 μm.

17. The method of claim 1, wherein the intermetallic alloy further comprises ≦2% Mo, ≦1% Zr, ≦2% Si, ≦30% Ni, ≦10% Cr, ≦0.3% C, ≦0.5% Y, ≦0.1% B, ≦1% Nb and ≦1% Ta.

18. The method of claim 1, wherein the intermetallic alloy further comprises 0.3–0.5% Mo, 0.05–0.3% Zr, 0.01–0.5% C, ≦0.1% B, ≦1% oxide particles, balance Fe.

19. The method of claim 1, wherein the sintering step provides an average grain size of about 10 to 30 μm.

20. The method of claim 1, wherein the powder includes elemental iron and 12 to 32 weight % aluminum powder.

21. A method of manufacturing an iron aluminide intermetallic alloy composition by a powder metallurgical technique, comprising:

a) forming a powder mixture comprising elemental aluminum powder and elemental iron powder without the use of a binder;

b) heating the powder mixture to react the aluminum powder and the iron powder to form a first reacted compact containing $Fe_2Al_5$, free-aluminum and free-iron;

c) heating the first reacted compact to react the free-iron with the free-aluminum and/or the $Fe_2Al_5$ to form a second reacted compact containing FeAl, $Fe_2Al_5$ and free-iron; and d) heating the second reacted compact to react the free-iron with the FeAl and/or the $Fe_2Al_5$ to form a pressureless sintered compact containing FeAl.

22. The method of claim 21, wherein b), c) and d) are carried out in a vacuum or in an inert gas atmosphere.

23. The method of claim 21, wherein the aluminum powder is completely melted during formation of the FeAl.

* * * * *

UNITED STATES PATENT AND TRADEMARK OFFICE

CERTIFICATE OF CORRECTION

PATENT NO. : 6,506,338 B1 
DATED : January 14, 2003
INVENTOR(S) : Shalva Gedevanishvili et al.

It is certified that error appears in the above-identified patent and that said Letters Patent is hereby corrected as shown below:

Column 1,
Line 30, "$B_2$" should read -- B2 --;

Column 8,
Line 3, "at 500º C., 600º C., and 1000º C." should read -- at 500º C., 600º C., 700º C., and at 1000º C. --;

Column 11,
Line 40, "≤ 1º C./min." should read -- ≥ 1º C./min. --; and

Column 12,
Lines 53 and 54, Claim 2, should read -- The method of claim 1, wherein the heating steps are each carried out in a vacuum or inert gas environment. --.

Signed and Sealed this

Twenty-ninth Day of July, 2003

JAMES E. ROGAN
*Director of the United States Patent and Trademark Office*